US008125431B2

(12) United States Patent
Kimura et al.

(10) Patent No.: US 8,125,431 B2
(45) Date of Patent: Feb. 28, 2012

(54) ELECTRO-OPTICAL DEVICE AND ELECTRONIC APPARATUS

(75) Inventors: Fusashi Kimura, Matsumoto (JP); Masaki Takahashi, Ichinomiya (JP); Atsunari Tsuda, Suwa (JP)

(73) Assignee: Sony Corporation, Tokyo (JP)

( * ) Notice: Subject to any disclaimer, the term of this patent is extended or adjusted under 35 U.S.C. 154(b) by 939 days.

(21) Appl. No.: 12/104,509

(22) Filed: Apr. 17, 2008

(65) Prior Publication Data

US 2008/0309304 A1 Dec. 18, 2008

(30) Foreign Application Priority Data

Jun. 18, 2007 (JP) ..... 2007-159827

(51) Int. Cl.
*G09G 3/36* (2006.01)

(52) U.S. Cl. ..... 345/95; 345/212

(58) Field of Classification Search ..... 345/95, 345/211, 212
See application file for complete search history.

(56) References Cited

U.S. PATENT DOCUMENTS 6,326,959 B1 * 12/2001 Tanaka ..... 345/211
6,459,330 B2 * 10/2002 Yasue ..... 327/538
6,628,252 B2 * 9/2003 Hoshino et al. ..... 345/82
7,456,818 B2 * 11/2008 Yamada ..... 345/99
7,800,566 B2 * 9/2010 Ha et al. ..... 345/82
7,889,190 B2 * 2/2011 Woo ..... 345/212
2003/0080955 A1 * 5/2003 Pulvirenti et al. ..... 345/212

FOREIGN PATENT DOCUMENTS

JP 2004-081369 3/2004
JP 2004-260931 9/2004

* cited by examiner

*Primary Examiner* — Chanh Nguyen
*Assistant Examiner* — Roy Rabindranath
(74) *Attorney, Agent, or Firm* — K&L Gates LLP

(57) ABSTRACT

The electro-optical device is directly connected to a battery and includes a display panel, a driver, and a voltage adjusting circuit. The driver amplifies an input voltage and supplies the amplified voltage to the display panel. The voltage adjusting circuit includes a plurality of conversion circuits, a switching unit, and a control circuit. The plurality of conversion circuits convert a voltage input from the battery into different voltages and supply the converted voltages to the driver. The switching unit performs switching for supplying the voltage to one of the plurality of conversion circuits. The control circuit controls the switching unit to switch the conversion circuit that supplies the voltage input from the battery when it is detected that a voltage gain of the driver has changed. Thus, the power consumption can be reduced without having an adverse effect on image display.

4 Claims, 5 Drawing Sheets

ELECTRO-OPTICAL DEVICE AND ELECTRONIC APPARATUS

The entire disclosure of Japanese Patent Application No. 2007-159827, filed Jun. 18, 2007 is expressly incorporated by reference herein.

BACKGROUND

1. Technical Field

The present invention relates to an electro-optical device suitable for display of various kinds of information.

2. Related Art

In a known electro-optical device, for example, in a liquid crystal device, a driver (hereinafter, simply referred to as an 'LCD driver') for driving a liquid crystal panel is connected with a flexible substrate (FPC: flexible printed circuit) and the flexible substrate is connected with an external electronic apparatus through a connector. A voltage is supplied to the LCD driver from a battery provided in the external electronic apparatus. A withstand voltage of an input voltage of the LCD driver is lower than a supply voltage supplied from a battery. Accordingly, in practice, the supply voltage from the battery is converted into a voltage adapted for the LCD driver by a regulator in the external electronic apparatus before the supply voltage from the battery is supplied to the LCD driver. After receiving the supply voltage from the battery through the regulator, the LCD driver amplifies the supply voltage to a voltage suitable for image display and then supplies the amplified voltage to the liquid crystal panel.

For example, JP-A-2004-81369 discloses a technique in which before changing an output voltage of a battery to a predetermined voltage by a regulator, the output voltage of the battery is boosted by a boosting circuit only when a voltage of the battery does not reach a predetermined voltage or more and the output voltage of the battery is not boosted by the voltage boosting circuit when the voltage of the battery reaches the predetermined voltage, thereby improving the power efficiency of the battery. Furthermore, JP-A-2004-260931 discloses a technique in which a voltage input to a backlight driving circuit is supplied directly from a battery during an operation period for which an output voltage of the battery is equal to or larger than a predetermined value and the voltage input to the backlight driving circuit is supplied through a regulator from a point of time at which the output voltage of the battery drops to a predetermined value or less, and accordingly, the use efficiency of the battery is improved and a value close to a discharge start voltage is maintained even if a drop in the output voltage of the battery increases.

However, in the case of the LCD driver, a voltage enough not to have an influence on image display may be supplied to a liquid crystal panel by changing a voltage gain according to an input voltage. Therefore, in the case when a voltage gain is relatively high, it may be inefficient to supply the same voltage from a battery to an LCD driver all the time in terms of power consumption. However, if a voltage input to an LCD driver is set to be low, image display may be adversely affected when the voltage gain is relatively low. Examinations on these points are not made in JP-A-2004-81369 and JP-A-2004-260931.

SUMMARY

An advantage of some aspects of the invention is to provide an electro-optical device capable of reducing the power consumption without having an adverse effect on image display.

According to an aspect of the invention, an electro-optical device to which a voltage of a battery is directly input includes: a display panel; a driver that amplifies an input voltage and supplies the amplified voltage to the display panel; and a voltage adjusting circuit having a plurality of conversion circuits that convert a voltage input from the battery into different voltages and supply the converted voltages to the driver, a switching unit that performs switching for supplying the voltage input from the battery to one of the plurality of conversion circuits, and a control circuit that controls the switching unit. When it is detected that the input voltage has changed, the driver supplies a voltage, which is amplified according to a voltage gain corresponding to the input voltage, to the display panel and supplies to the control circuit a control signal indicating a change in voltage gain. The control circuit controls the switching unit to switch a conversion circuit, which supplies the voltage input from the battery, when the control signal indicating the change in voltage gain is received.

A voltage of the battery is directly input to the electro-optical device, and the electro-optical device includes the display panel, the driver, and the voltage adjusting circuit. The display panel is a liquid crystal panel, for example. The driver is an LCD driver that drives a liquid crystal panel, for example, and amplifies an input voltage and supplies the amplified voltage to the display panel. The voltage adjusting circuit includes the plurality of conversion circuits, the switching unit, and the control circuit. The plurality of conversion circuits are a plurality of regulators, for example, and convert the voltage input from the battery into different voltages and supply the converted voltages to the driver. The switching unit is a switching circuit, for example, and performs switching for supplying the voltage input from the battery to one of the plurality of conversion circuits. When it is detected that the input voltage has changed, the driver supplies a voltage, which is amplified according to a voltage gain corresponding to the input voltage, to the display panel and supplies to the control circuit a control signal indicating a change in voltage gain. The control circuit controls the switching unit to switch a conversion circuit, which supplies the voltage input from the battery, when the control signal indicating the change in voltage gain is received. Thus, it becomes possible to reduce the power consumption without affecting the image display of the display panel.

In the electro-optical device described above, preferably, when it is detected that the input voltage has changed, the driver supplies to the control circuit a control signal indicating an increase in voltage gain if the voltage gain of the input voltage is made larger than the voltage gain before detecting the change in input voltage. Preferably, when the control circuit receives the control signal indicating the increase in voltage gain, the control circuit controls the switching unit to switch a conversion circuit, which supplies the voltage input from the battery, to a conversion circuit that performs conversion into a lower voltage than a conversion circuit that has supplied the voltage input from the battery before receiving the control signal. The control circuit can detect that the voltage has been amplified in the driver by receiving the control signal from the driver. In addition, after detecting that the voltage has been amplified in the driver, the control circuit switches a conversion circuit, which supplies the voltage input from the battery, to a conversion circuit, which performs conversion into a lower voltage than a conversion circuit that has supplied the voltage input from the battery before receiving the control signal. Accordingly, it is possible to reduce the power consumption without affecting the image display of the display panel.

Furthermore, in the electro-optical device described above, preferably, the voltage adjusting circuit includes: a voltage comparing circuit that detects whether or not the voltage input from the battery is equal to or larger than a predetermined voltage; and a voltage boosting circuit that boosts the voltage input from the battery. When it is detected that the voltage input from the battery is lower than the predetermined voltage, the voltage adjusting circuit boosts the voltage input from the battery with the voltage boosting circuit and then supplies the boosted voltage to the conversion circuits. The predetermined voltage is a detection level voltage, for example, and is set beforehand on the basis of a minimum voltage that is required for suitable image display and is supplied to the display panel. In this manner, a constant voltage can be supplied from the conversion circuit to the driver all the time even when the voltage input from the battery changes abruptly. As a result, the brightness of a display screen of the display panel can be properly maintained.

Furthermore, in the electro-optical device described above, it is preferable to further include: a lighting device that supplies light to the display panel; and a light source driver that drives a light source of the lighting device. Preferably, the light source driver has the voltage adjusting circuit. The light source is an LED (light emitting diode), for example, and the light source driver is an LED driver, for example. A typical LED driver originally includes all constituent components that form the voltage adjusting circuit. Therefore, in this way, it becomes not necessary to additionally provide a new circuit.

According to another aspect of the invention, an electronic apparatus includes: the above-described electro-optical device serving as a display unit; and a battery that directly inputs a voltage to the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the accompanying drawings.

Configuration of a Liquid Crystal Device

Figure 1:
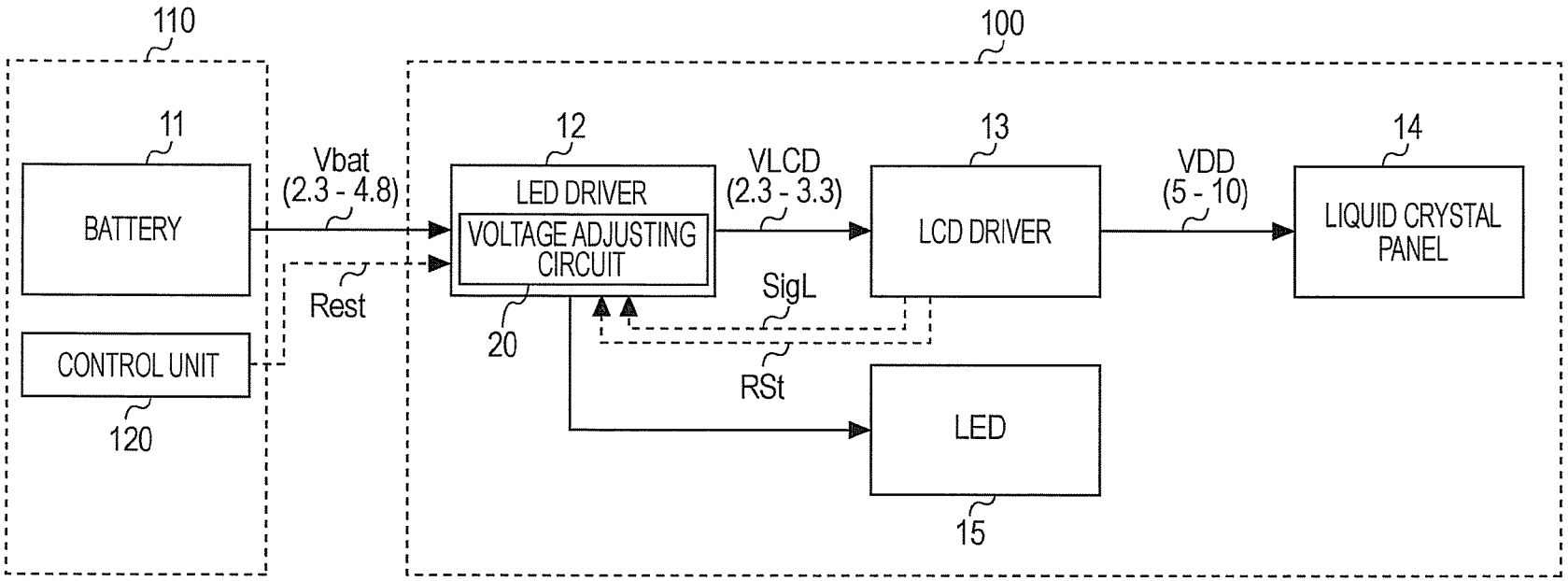
FIG. 1 is a block diagram schematically illustrating the configuration of a liquid crystal device according to an embodiment.

First, the configuration of a liquid crystal device according to the present embodiment will be described with reference to FIG. 1. FIG. 1 is a block diagram schematically illustrating the configuration of a liquid crystal device 100 according to the present embodiment. The liquid crystal device 100 mainly includes an LED driver 12, an LCD driver 13, and a liquid crystal panel 14 and is connected with a battery 11 provided in an external electronic apparatus 110. In addition, in FIG. 1, a solid line arrow indicates the flow of a voltage and a broken line arrow indicates the flow of a control signal. In addition, writing in parentheses below a reference numeral indicating a voltage indicates a value of the voltage or a range of the voltage. The same is true for FIG. 2 to be described later.

The liquid crystal device 100 is a TFT (thin film transistor) type liquid crystal device, for example. Similar to a typical TFT type liquid crystal device, in the liquid crystal device 100, the liquid crystal panel 14 has two substrates disposed opposite to each other. Scanning electrodes and signal electrodes are formed on one of the substrates and a common electrode is formed on the other substrate, and a liquid crystal layer is sealed between the two substrates. In addition, the liquid crystal device 100 includes a lighting device (not shown) and the lighting device supplies light to the liquid crystal panel 14. Thus, the liquid crystal panel 14 is lighted. As a light source of the lighting device, an LED (light emitting diode) 15 that is a light emitting element is used, for example. In addition, the LCD driver 13 is mounted on one substrate of the liquid crystal panel 14 and is connected with an FPC (flexible printed circuit). Here, in the liquid crystal device 100 according to the present embodiment, the LED driver 12 for driving the LED 15 is mounted on the FPC, for example, and a voltage of the battery 11 is directly input to the LED driver 12 through a connector connected with the outside of the FPC. That is, unlike a typical liquid crystal device, the liquid crystal device 100 according to the present embodiment includes the LED driver 12 and an output voltage of the external battery 11 is directly input to the LED driver 12 without a voltage adjusting circuit or the like provided therebetween.

The battery 11 is a battery provided in the external electronic apparatus 110 and selves to supply a voltage Vbat to the LED driver 12. In the liquid crystal device 100 according to the present embodiment, the voltage Vbat is in a range of 2.3 to 4.8 V, for example.

The LED driver 12 serves to drive the LED 15 that is a light source of a lighting device. The LED driver 12 has a voltage adjusting circuit 20. The LED driver 12 adjusts the voltage Vbat supplied from the battery 11 by using the voltage adjusting circuit 20 and then supplies the adjusted voltage Vbat to the LCD driver 13 as a voltage VLCD. The voltage adjusting circuit 20 will be described in detail later. In the liquid crystal device 100 according to the present embodiment, the VLCD is in a range of 2.3 to 3.3 V, for example.

The LCD driver 13 serves to drive the liquid crystal panel 14. Specifically, the LCD driver 13 is connected with the common electrode, the scanning electrodes, and the signal electrodes of the liquid crystal panel 14 and changes a gray-scale level in a display screen of the liquid crystal panel 14 by applying a voltage to a liquid crystal layer of the liquid crystal panel 14 so as to change an alignment state of liquid crystal molecules. The voltage VLCD is supplied from the LED driver 12 to the LCD driver 13. Then, the LCD driver 13 amplifies the supplied voltage VLCD and supplies the amplified voltage VLCD to the liquid crystal panel 14 as a voltage VDD. Specifically, the LCD driver 13 has a function of detecting a change in the voltage VLCD supplied from the LED driver 12 and changes a voltage gain of the voltage VLCD according to the detected voltage VLCD. For example, in the liquid crystal device 100 according to the present embodiment, the LCD driver 13 can switch the voltage gain between twice and three times according to the detected voltage VLCD. As a result, the LCD driver 13 can supply a voltage, which is obtained by amplifying the voltage VLCD twice or three times, to the liquid crystal panel 14 as the voltage VDD. In the liquid crystal device 100 according to the present embodiment, the voltage VDD is in a range of 5 to 10 V, for example.

In practice, in order to make the voltage VLCD adapted for a withstand voltage of a voltage of the liquid crystal panel 14, the LCD driver 13 does not immediately amplify the voltage VLCD twice or three times but drops the voltage VLCD to a lower voltage and then amplifies the voltage VLCD twice or three in many cases. However, in the following description, for the convenience of explanation, it is assumed that the LCD driver 13 immediately amplifies the voltage VLCD twice or three times to thereby obtain the voltage VDD and supplies the voltage VDD to the liquid crystal panel 14.

Figure 2:
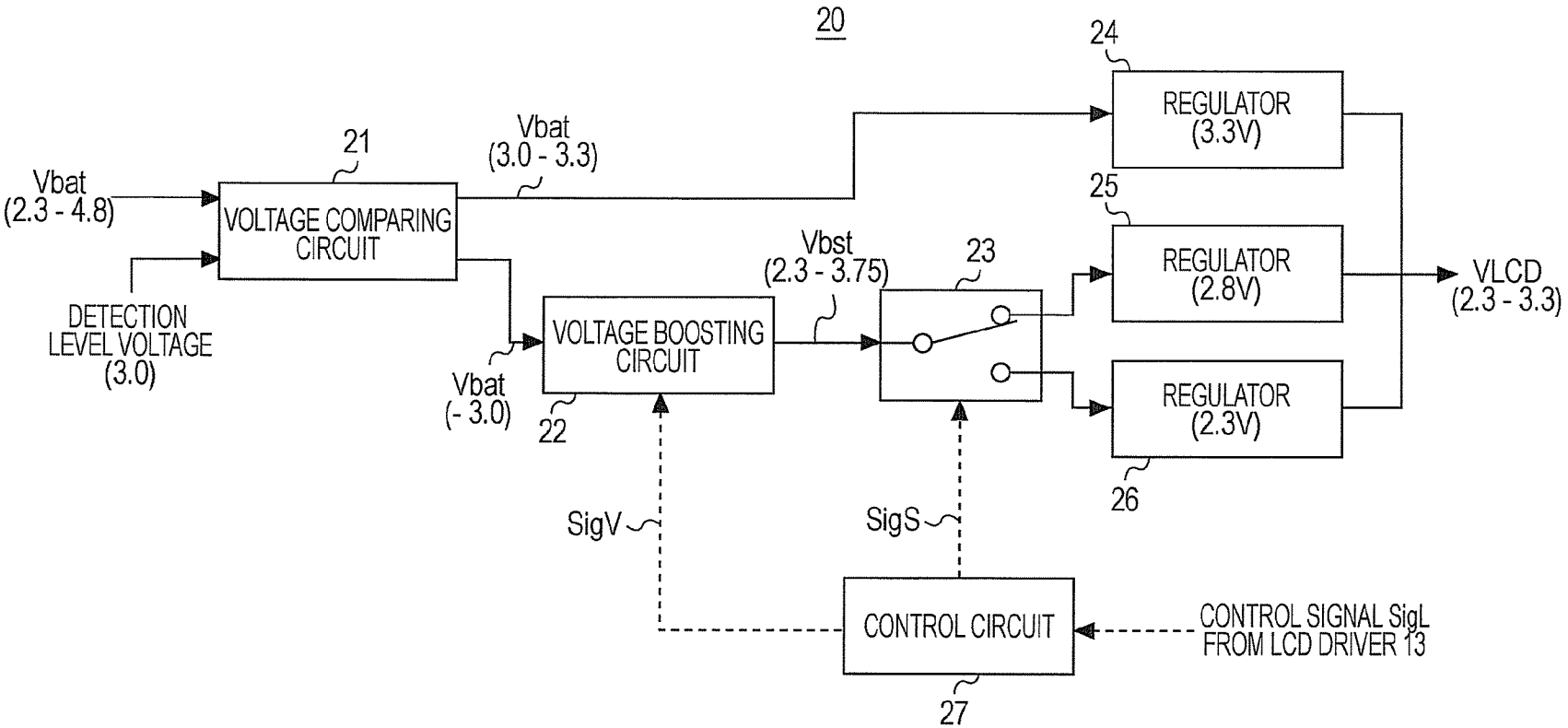
FIG. 2 is a block diagram schematically illustrating the configuration of a voltage adjusting circuit.

Here, the configuration of the voltage adjusting circuit 20 of the LED driver 12 will be described with reference to FIG. 2. FIG. 2 is a view schematically illustrating the configuration of the voltage adjusting circuit 20.

The voltage adjusting circuit 20 is configured to include a voltage comparing circuit 21, a voltage boosting circuit 22, a switching circuit 23, regulators 24 to 26, and a control circuit 27.

Each of the regulators 24 to 26 has a function of changing an input voltage to a constant voltage and outputting the constant voltage. The regulators 24 to 26 convert an input voltage into different voltages and supply the voltages to the LCD driver 13 as the voltage VLCD. For example, in the voltage adjusting circuit 20 according to the present embodiment, the regulator 24 converts an input voltage into 3.3 V, the regulator 25 converts an input voltage into 2.8 V, and the regulator 26 converts the input voltage into 2.3 V. In addition, when a voltage higher than a set constant voltage is input, each of the regulators 24 to 26 changes the voltage to the constant voltage. When a voltage lower than the set constant voltage is input, each of the regulators 24 to 26 outputs the input voltage without any change.

The voltage comparing circuit 21 is formed by using a comparison circuit (comparator), for example. A detection level voltage and the voltage Vbat supplied from the battery 11 are input to the voltage comparing circuit 21. The voltage comparing circuit 21 detects whether or not the voltage Vbat is equal to or larger than the detection level voltage. Then, the voltage comparing circuit 21 supplies the voltage Vbat to the regulator 24 when the voltage Vbat is equal to or larger than the detection level voltage and supplies the voltage Vbat to the voltage boosting circuit 22 when the voltage Vbat is lower than the detection level voltage. In addition, the detection level voltage is set beforehand on the basis of a minimum voltage that is required for suitable image display and is supplied to the liquid crystal panel 14.

The voltage boosting circuit 22 is formed by using a DC-DC converter, for example, and has a function of boosting an input voltage and outputting the boosted voltage. Specifically, the voltage boosting circuit 22 boosts the voltage Vbat supplied from the voltage comparing circuit 21 and supplies the boosted voltage Vbat to the switching circuit 23 as a voltage Vbst. A boosted voltage of the voltage boosting circuit 22 is controlled by the control circuit 27.

The switching circuit 23 has a switching function of supplying the voltage Vbst, which is supplied from the voltage boosting circuit 22, to one of the regulators 25 and 26. The switching circuit 23 is controlled by the control circuit 27.

The control circuit 27 controls the switching circuit 23 by supplying a control signal SigS to the switching circuit 23 on the basis of a control signal SigL from the LCD driver 13 and controls the voltage boosting circuit 22 by supplying a control signal SigV to the voltage boosting circuit 22.

In the liquid crystal device 100 according to the present embodiment, when it is detected that a voltage gain of the voltage VLCD supplied from the LED driver 12, which is amplified by the LCD driver 13, has been changed, the control circuit 27 controls the switching circuit 23 to switch a regulator to which the voltage Vbst is supplied. Thus, it is possible to reduce the power consumption without affecting the image display of the liquid crystal panel 14. This will be described in detail later.

In FIG. 1, a reset signal Rset supplied from a control unit 120 of the external electronic apparatus 110 is supplied to the LED driver 12. The LED driver 12 that has received the reset signal Rest stabilizes the voltage VLCD supplied to the LCD driver 13 by performing a reset operation. The LCD driver 13 supplies a detection signal RSt to the LED driver 12 when it is detected that the voltage VLCD has been stabilized. The LED driver 12 which has received the detection signal RSt stops the reset operation. Thereby, timing of the reset operation of the voltage VLCD in the LED driver 12 can be made suitable.

Voltage Control Method

A voltage control method of the liquid crystal device 100 according to the present embodiment will be specifically described with reference to FIGS. 3 and 4.

As described above, in the liquid crystal device 100 according to the present embodiment, when it is detected that a voltage gain of the voltage VLCD supplied from the LED driver 12, which is amplified by the LCD driver 13, has been changed, the control circuit 27 controls the switching circuit 23 to switch a regulator to which the voltage Vbst is supplied.

For example, when the input voltage VLCD has been changed, the LCD driver 13 supplies the control signal SigL to the control circuit 27 if a voltage gain of the voltage VLCD is made larger than a voltage gain before detecting the change in the voltage VLCD. The control circuit 27 of the LED driver 12 that has received the control signal SigL controls the switching circuit 23 to perform switching such that the voltage Vbst is supplied to a regulator that outputs a voltage lower than a regulator to which the voltage Vbst has been supplied before receiving the control signal SigL. Thus, it is possible to reduce the power consumption without affecting the image display of the liquid crystal panel 14. This will now be described in detail.

First, a voltage control method at the time of normal driving of the liquid crystal device 100 will be described with reference to FIG. 3. FIG. 3 is a graph illustrating the above-described voltages changing with time at the time of normal driving. At this time, it is assumed that the LED 15 is not lighted. In FIG. 3, a voltage VR indicates a minimum voltage, which is required for suitable image display and is supplied to the liquid crystal panel 14. Here, the minimum voltage VR is set to 5.25 V. Moreover, even though a graph of the voltage VDD is shown in approximately a straight line, the graph of the voltage VDD actually fluctuates in a range of a voltage higher than the voltage VR due to a change in the voltage VLCD supplied to the LCD driver 13 and a change in a voltage gain. Furthermore, in FIG. 3, 'X2' indicates that a voltage gain in the LCD driver 13 is set to twice and 'X3' indicates that the voltage gain in the LCD driver 13 is set to three times. The same is true for FIG. 4 to be described later.

Figure 3:
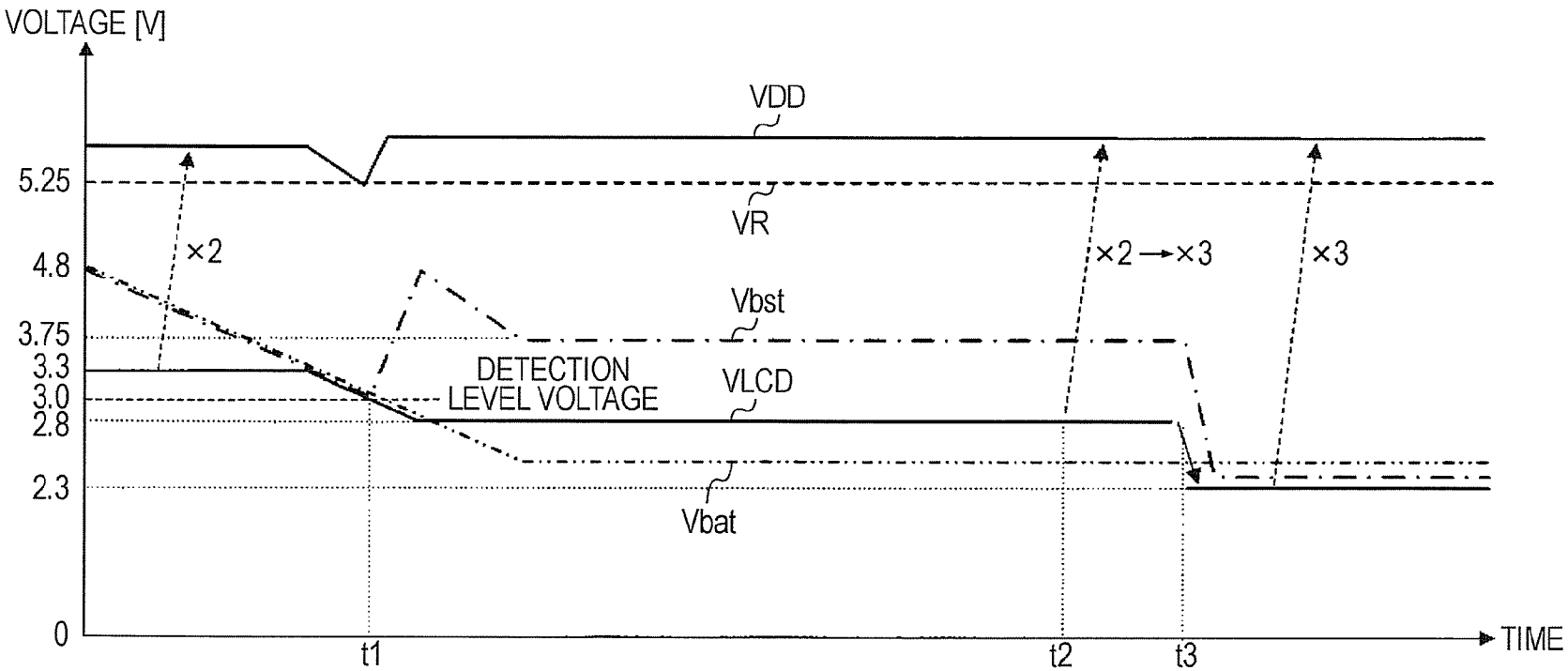
FIG. 3 is a view illustrating each voltage changing with time at the time of normal driving.

As shown in FIG. 3, it is assumed that the voltage Vbat supplied from the battery 11 to the LED driver 12 is first 4.8 V and drops with time and finally becomes about 2.5 V. Here, assuming that a detection level voltage input to the voltage comparing circuit 21 in the LED driver 12 is 3.0 V, in the voltage adjusting circuit 20, the voltage Vbat is supplied from the voltage comparing circuit 21 to the regulator 24 and is then output as the voltage VLCD to the LCD driver 13 until the voltage Vbat reaches 3.0 V, that is, until time t1. Accordingly, the voltage VLCD supplied from the LED driver 12 to the LCD driver 13 is set to 3.3 V until the voltage Vbat reaches from 4.8 V to 3.3 V, and the voltage VLCD becomes equal to the voltage Vbat until the voltage Vbat reaches from 3.3 V to 3.0 V.

At this time, the LCD driver 13 doubles the voltage VLCD supplied from the LED driver 12 and supplies the doubled voltage VLCD to the liquid crystal panel 14. The reason is that the voltage VDD becomes 6.0 V or more by doubling a voltage gain since the range of the voltage Vbat at that time is 3.0 to 3.3 V, and accordingly, the voltage VDD can exceed the minimum voltage VR (5.25 V). As a result, an image can be appropriately displayed on a display screen of the liquid crystal panel 14.

From time t1 to time t3, the voltage Vbat that has dropped below the detection level voltage of 3.0 V is supplied from the voltage comparing circuit 21 to the voltage boosting circuit 22. Then, for example, the voltage Vbat of 2.5 V is boosted 1.5 times to become the voltage Vbst (3.75 V). In this case, the voltage Vbst is higher than 3.75 V during a period until the voltage Vbat drops from a voltage 3.0 V to a voltage 2.5 V. Originally, since the switching circuit 23 is set such that the voltage Vbst is supplied to the regulator 25, the voltage Vbst is supplied to the regulator 25, and accordingly, the voltage VLCD becomes 2.8 V. Thus, by causing the voltage boosting circuit 22 to boost the voltage Vbat to a voltage higher than the constant voltage 2.8 V of the regulator 25, the constant voltage 2.8 V can be consistently supplied as the voltage VLCD to the LCD driver 13 in the case when the voltage Vbat changes abruptly for a certain reason, for example, even in the case when the voltage Vbat drops to a voltage lower than 2.8 V. As a result, the brightness of a display screen of the liquid crystal panel 14 can be properly maintained.

Until the time t2 at which it is detected that the voltage VLCD has changed from 3.3 V to 2.8 V, the LCD driver 13 doubles the voltage VLCD supplied from the LED driver 12 and then supplies the doubled voltage VLCD as the voltage VDD to the liquid crystal panel 14. Accordingly, since the voltage VDD at that time becomes 5.6 V to thereby exceed the minimum voltage VR (5.25 V), an image can be appropriately displayed on the display screen of the liquid crystal panel 14.

When it is detected that the voltage supplied from the LED driver 12 has changed from 3.3 V to 2.8 V at time t2, the LCD driver 13 switches the voltage gain from twice to three times. After switching the voltage gain from twice to three times, the LCD driver 13 supplies the control signal SigL, which indicates that the voltage gain has changed from twice to three times, to the control circuit 27 of the voltage adjusting circuit 20. Accordingly, the control circuit 27 can detect that the voltage gain in the LCD driver 13 has changed.

At time t3, when the control circuit 27 receives the control signal SigL from the LCD driver 13, the control circuit 27 controls the switching circuit 23 to perform switching such that the voltage Vbst is supplied to the regulator 26 from the regulator 25 and also controls the voltage boosting circuit 22 to drop a boosted voltage. For example, the voltage Vbat of 2.5 V is set to the voltage Vbst without voltage boosting. Thus, the voltage VLCD is set to 2.8 V to 2.3 V. At this time, since a voltage gain is already set to three times, the voltage VDD becomes 6.9 V even if the voltage VLCD switches from 2.8 V to 2.3 V. Accordingly, the voltage VDD can exceed the minimum voltage VR (5.25 V). As a result, even if the voltage VLCD switches from 2.8 V to 2.3 V, there is almost no influence on image display of the liquid crystal panel 14. In addition, it is possible to reduce the power consumption by switching the voltage VLCD from 2.8 V to 2.3 V. That is, since the LED driver 12 switches the voltage VLCD from 2.8 V to 2.3 V after detecting that the voltage gain in the LCD driver 13 has switched from twice to three times, the power consumption can be reduced without having an effect on the image display of the liquid crystal panel 14.

Furthermore, in the case when the LED 15 is lighted, the control circuit 27 makes a control such that the voltage Vbst is always higher than 3.3 V in order to maintain lighting of the LED 15, and accordingly, the voltage VLCD is held to 3.3 V all the time. Therefore, in this case, since the voltage VDD always exceeds the minimum voltage VR even if the voltage gain of the voltage VLCD is maintained twice in the LCD driver 13, there is almost no influence on the image display of the liquid crystal panel 14.

To sum up, in the liquid crystal device 100 according to the present embodiment, the LCD driver 13 changes the voltage gain of the voltage VLCD when a change in the voltage VLCD is detected. For example, in the case where the voltage VLCD supplied from the LED driver 12 is set to 3.3 V and the voltage gain at this time is set to twice, the LCD driver 13 switches the voltage gain from twice to three times when the voltage VLCD changes from 3.3 V to 2.8 V. In addition, the LCD driver 13 supplies the control signal SigL to the voltage adjusting circuit 20 of the LED driver 12 after switching the voltage gain, and the control circuit 27 of the voltage adjusting circuit 20 switches the voltage VLCD by detecting that the voltage gain has changed when the control signal SigL is received. For example, the control circuit 27 of the voltage adjusting circuit 20 switches the voltage VLCD from 2.8 V to 2.3 V. Thus, the LED driver 12 receives the control signal SigL to thereby detect that the voltage gain in the LCD driver 13 has switched from twice to three times and then switches the voltage VLCD from 2.8 V to 2.3 V that is a lower voltage. As a result, the power consumption can be reduced without having an effect on the image display of the liquid crystal panel 14.

That is, in the liquid crystal device 100 according to the present embodiment, when it is detected that a voltage gain of the voltage VLCD supplied from the LED driver 12, which is amplified by the LCD driver 13, has been changed, the control circuit 27 controls the switching circuit 23 to switch a regulator to which the voltage Vbst is supplied. Thus, it is possible to reduce the power consumption without affecting the image display of the liquid crystal panel 14.

Next, a voltage control method when power is supplied to the liquid crystal device 100 will be described with reference to FIG. 4. FIG. 4 is a graph illustrating the above-described voltages changing with time in the case where a voltage supplied from a battery is equal to or smaller than a detection level voltage at the time of supply of power. At this time, it is assumed that the LED 15 is not lighted.

Figure 4:
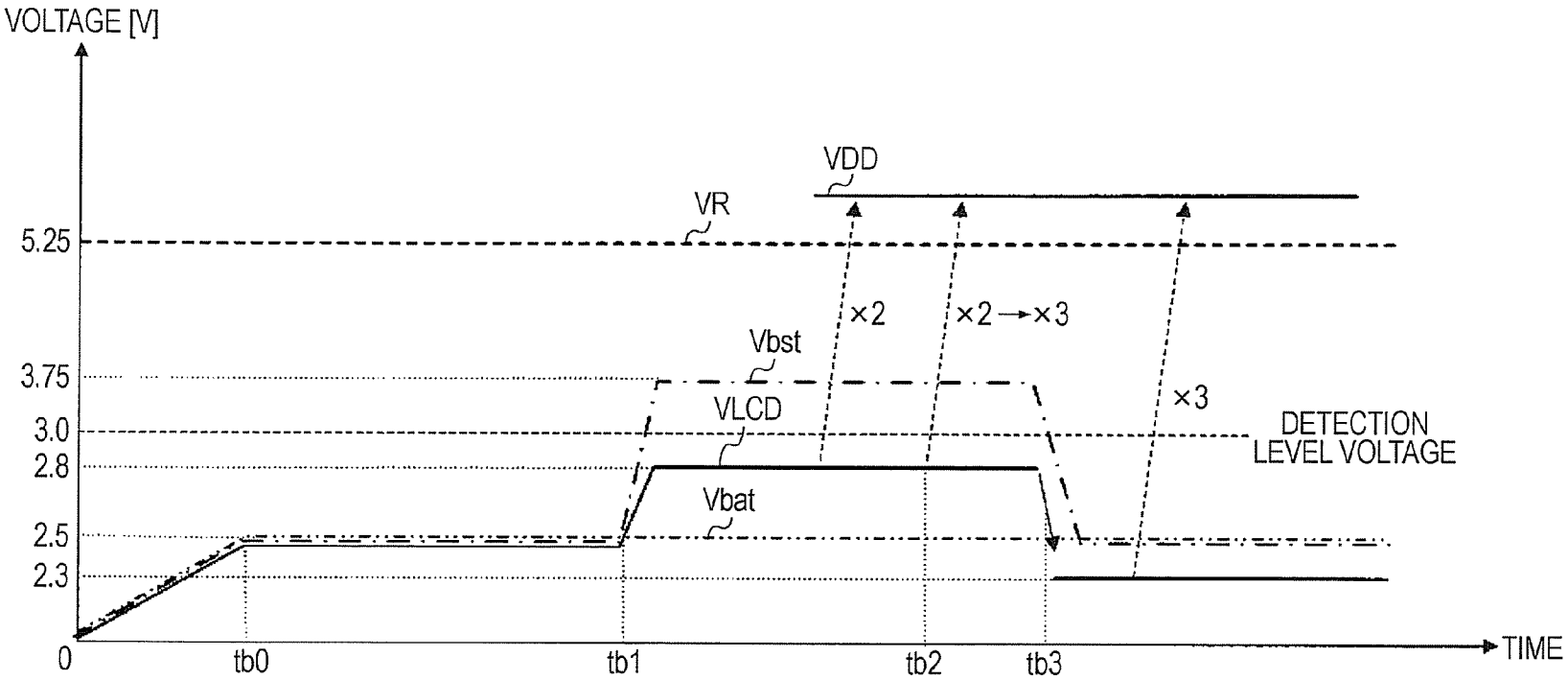
FIG. 4 is a graph illustrating each voltage changing with time in the case where a voltage supplied from a battery is equal to or smaller than a detection level voltage.

As shown in FIG. 4, the voltage Vbat supplied from the battery 11 to the LED driver 12 is boosted from zero to 2.5 V at the beginning but is not boosted up to a voltage higher than 2.5 V after time tb0. Since the Vbat is also 2.5 V at time tb1 at which the voltage adjusting circuit 20 has detected the voltage Vbat, the Vbat is lower than the detection level voltage of 3.0 V. Accordingly, from time tb1 to time tb2, the voltage Vbat is supplied from the voltage comparing circuit 21 to the voltage boosting circuit 22 and is then boosted, thereby becoming the voltage Vbst (3.75 V). Originally, since the switching circuit 23 is set such that the voltage Vbst is supplied to the regulator 25, the voltage Vbst is supplied to the regulator 25, and accordingly, the voltage VLCD becomes 2.8 V. Thus, also in an example shown in FIG. 4, by causing the voltage boosting circuit 22 to boost the voltage Vbat to a voltage higher than the constant voltage 2.8 V of the regulator 25, the constant voltage 2.8 V can be consistently supplied as the voltage VLCD to the LCD driver 13 even in the case when the voltage Vbat changes abruptly for a certain reason. As a result, the brightness of a display screen of the liquid crystal panel 14 can be properly maintained.

Until the time tb2 at which it is detected that the voltage VLCD has changed to 2.8 V, the LCD driver 13 doubles the voltage VLCD supplied from the LED driver 12 and then supplies the doubled voltage VLCD to the liquid crystal panel 14. Since the voltage VDD at that time becomes 5.6 V, the voltage VDD can exceed the minimum voltage VR (5.25 V).

When it is detected that the voltage supplied from the LED driver 12 has changed to 2.8 V at time tb2, the LCD driver 13 changes the voltage gain from twice to three times (time tb2). After changing the voltage gain from twice to three times, the LCD driver 13 supplies the control signal SigL, which indicates that the voltage gain has changed from twice to three times, to the control circuit 27 of the voltage adjusting circuit 20.

When the control circuit 27 receives the control signal SigL from the LCD driver 13, the control circuit 27 controls the switching circuit 23 to perform switching such that the voltage Vbst is supplied to the regulator 26 and also controls the voltage boosting circuit 22 to drop a boosted voltage (time tb3). Thus, the voltage VLCD is set to 2.3 V. At this time, since a voltage gain is already set to three times, the voltage VDD can exceed the minimum voltage VR (5.25 V) even if the voltage VLCD switches from 2.8 V to 2.3 V. As a result, even if the voltage VLCD switches from 2.8 V to 2.3 V, there is almost no influence on image display of the liquid crystal panel 14. In addition, it is possible to reduce the power consumption by switching the voltage VLCD from 2.8 V to 2.3 V. That is, since the LED driver 12 switches the voltage VLCD from 2.8 V to 2.3 V after detecting that the voltage gain in the LCD driver 13 has switched from twice to three times, the power consumption can be reduced without having an effect on the image display of the liquid crystal panel 14.

As can be understood from the above description, also in the example shown in FIG. 4, in the liquid crystal device 100 according to the present embodiment, the control circuit 27 controls the switching circuit 23 to switch a regulator to which the voltage Vbst is supplied when it is detected that a voltage gain of the voltage VLCD supplied from the LED driver 12, which is amplified by the LCD driver 13, has been changed. Thus, it is possible to reduce the power consumption without affecting the image display of the liquid crystal panel 14.

Furthermore, in a typical liquid crystal device, a fixed voltage is set as a voltage that can be input to the liquid crystal device. Accordingly, in an external electronic apparatus, it has been necessary to convert a voltage supplied from a battery into the fixed voltage by using a regulator provided in the external electronic apparatus and then to supply the converted voltage to the liquid crystal device. In contrast, in the liquid crystal device 100 according to the present embodiment, the voltage conversion is performed by a regulator provided in the liquid crystal device 100. Accordingly, since a voltage that can be input to the liquid crystal device 100 can have a fixed value, the liquid crystal device 100 can be directly connected to the battery 11.

Furthermore, in a typical liquid crystal device, an external electronic apparatus includes an LED driver and the LED driver controls driving of an LED of a lighting device through an FPC. In contrast, in the liquid crystal device 100 according to the present embodiment, the liquid crystal device 100 includes the LED driver 12, and conversion or boosting of a voltage is performed by using the voltage adjusting circuit 20 provided in the LED driver 12. Atypical LED driver originally has all constituent components, such as the voltage comparing circuit 21, the voltage boosting circuit 22, the regulators 24 to 26, and the switching circuit 23, which form the voltage adjusting circuit 20. Therefore, since it can be said that the typical LED driver originally has the voltage adjusting circuit 20, it becomes not necessary to additionally provide a new circuit by performing the conversion or boosting of a voltage using the voltage adjusting circuit 20 provided in the LED driver 12 in the liquid crystal device 100 according to the present embodiment.

Thus, in the liquid crystal device 100 according to the present embodiment, a voltage adjusting circuit provided separately from the LED driver 12 may also be used instead of using the voltage adjusting circuit 20 that is originally provided in the LED driver 12. Even in this case, it is needless to say that the effects of the invention, that is, the effects that the power consumption can be reduced without affecting the image display of the liquid crystal panel 14 can be achieved.

Furthermore, the voltage adjusting circuit 20 according to the present embodiment is provided with the voltage boosting circuit 22, and the voltage boosting circuit 22 serves to output a constant voltage from a regulator even if the voltage Vbat changes abruptly as described above. Therefore, even if the voltage comparing circuit 21 and the switching circuit 23 are directly connected to each other without providing the voltage boosting circuit 22, the effects of the invention, that is, the effects that the power consumption can be reduced without affecting the image display of the liquid crystal panel 14 can be achieved.

In addition, the invention may also be applied to a reflective liquid crystal device (LCOS) in which elements are formed on a silicon substrate, a plasma display (PDP), a field emission type display (FED, SED), an organic EL display, a digital micromirror device (DMD), an electrophoresis device, and the like, in addition to the liquid crystal device described in the above-mentioned embodiments.

Electronic Apparatus

Next, specific examples of an electronic apparatus to which the liquid crystal device 100 according to each embodiment can be applied will be described with reference to FIGS. 5A and 5B. An electronic apparatus described below includes the battery 11 that directly inputs a voltage to the liquid crystal device according to the present embodiment.

First, an example in which the liquid crystal device 100 according to each embodiment is applied to a display unit of a portable personal computer (so-called notebook computer) will be described. FIG. 5A is a perspective view illustrating the configuration of the personal computer. As shown in the drawing, the personal computer 710 is configured to include a main body 712 provided with a keyboard 711 and a display unit 713 to which the liquid crystal device 100 according to the embodiment of the invention is applied.

Then, an example in which the liquid crystal device 100 according to each embodiment is applied to a display unit of a mobile phone will be described. FIG. 5B is a perspective view illustrating the configuration of the mobile phone. As shown in the drawing, a mobile phone 720 is configured to include a plurality of operation buttons 721, an earpiece 722, a mouthpiece 723, and a display unit 724 to which the liquid crystal device 100 according to the embodiment of the invention is applied.

Figure 5A:
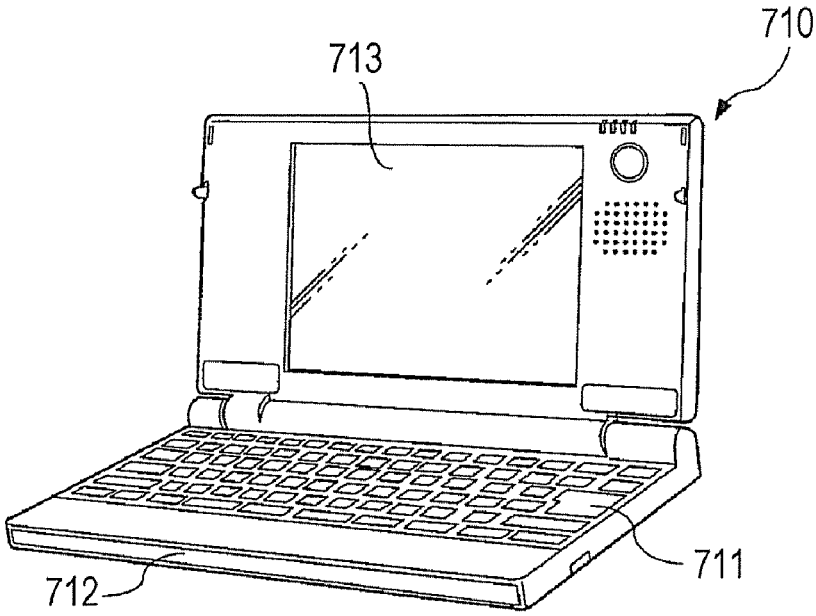
FIG. 5A is a view illustrating an example of an electronic apparatus to which a liquid crystal device according to each embodiment is applied.
Figure 5B:
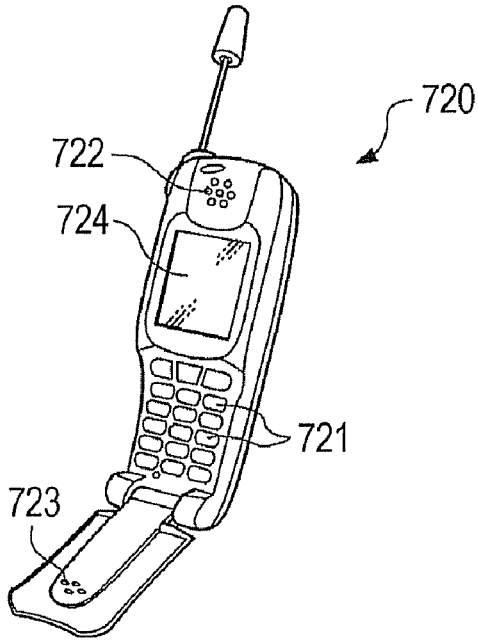
FIG. 5B is a view illustrating an example of an electronic apparatus to which a liquid crystal device according to each embodiment is applied.

Moreover, an electronic apparatus to which the liquid crystal device 100 according to each embodiment can be applied includes a liquid crystal television, a view finder type or monitor direct view type video tape recorder, a car navigation system, a pager, an electronic diary, an electronic calculator, a word processor, a workstation, a video phone, a POS terminal, a digital still camera, and the like, as well as the personal computer shown in FIG. 5A or a mobile phone shown in FIG. 5B.

What is claimed is:

1. An electro-optical device comprising:

(i) a display panel;

(ii) a driver; and (iii) a voltage adjusting circuit having:

(a) a voltage comparing circuit, (b) a plurality of conversion circuits that convert an input voltage from a battery into a converted voltage and supply the converted voltage to the driver, (c) a switching unit that performs switching for supplying the input voltage to one of the plurality of conversion circuits, and (d) a control circuit that controls the switching unit;

wherein when the voltage comparing circuit detects that the input voltage has changed, (i) the driver:

(a) amplifies the converted voltage according to a voltage gain corresponding to the input voltage, (b) supplies the amplified voltage to the display panel, and (c) supplies to the control circuit a control signal indicating a change in voltage gain; and (ii) the control circuit controls the switching unit to switch a conversion circuit when the control signal indicating the change in voltage gain is received;

(iii) wherein when the voltage comparing circuit detects that the input voltage has changed, the driver supplies to the control circuit a control signal indicating an increase in voltage gain if the voltage gain of the input voltage is made larger than the voltage gain before detecting the change in input voltage, and when the control circuit receives the control signal indicating the increase in voltage gain, the control circuit controls the switching unit to switch a first conversion circuit to a second conversion circuit that performs conversion into a lower voltage than the first conversion circuit that converted the input voltage before receiving the control signal.

2. The electro-optical device according to claim 1, wherein the voltage adjusting circuit includes:

a voltage boosting circuit that boosts the input voltage, wherein when the voltage comparing circuit detects that the input voltage is lower than a predetermined voltage, the voltage adjusting circuit boosts the input voltage with the voltage boosting circuit and then supplies the boosted voltage to the conversion circuits.

3. The electro-optical device according to claim 1, further comprising:

a lighting device that supplies light to the display panel; and a light source driver that drives a light source of the lighting device, wherein the light source driver has the voltage adjusting circuit.

4. An electronic apparatus comprising:

the electro-optical device according to claim 1 serving as a display unit; and a battery that directly inputs a voltage to the electro-optical device.

* * * * *